United States Patent [19]

McNair et al.

[11] Patent Number: 4,700,110

[45] Date of Patent: Oct. 13, 1987

[54] LAMP SWITCHING

[75] Inventors: Rhett McNair, 4081-G E. LaPalma, Anaheim, Calif. 92807; Martin E. G. Willcocks, Los Angeles, Calif.

[73] Assignee: Rhett McNair, Anaheim, Calif.

[21] Appl. No.: 859,997

[22] Filed: May 5, 1986

[51] Int. Cl.[4] ..... H05B 39/10

[52] U.S. Cl. ..... 315/87; 315/88; 315/90

[58] Field of Search ..... 315/88, 90, 87

[56] References Cited

U.S. PATENT DOCUMENTS

| | | | |
|---|---|---|---|
| 2,476,517 | 7/1949 | Titus | 315/87 |
| 3,636,404 | 1/1972 | Appelton | 315/87 |
| 3,693,045 | 9/1972 | Price | 315/87 |
| 3,917,969 | 11/1975 | Olsen | 307/252 B |
| 4,075,501 | 2/1978 | Kondo | 307/41 |
| 4,322,632 | 3/1982 | Hart et al. | 307/41 |
| 4,480,197 | 10/1984 | Hollaway | 307/252 R |

OTHER PUBLICATIONS

"Automatic Emergency Light" by Philip Watson, Electronics, Australia, Oct. 1978, pp. 52, 53.

*Primary Examiner*—Harold Dixon

*Attorney, Agent, or Firm*—James C. Wray

[57] ABSTRACT

A second lamp is connected to power terminals upon each alternate switching off of a first lamp so that, upon each alternate switching on of the first lamp, the second lamp is illuminated. A magnetic latching relay switches the second lamp into and out of the circuit. The relay is powered by the discharge of one of two capacitors. One capacitor powers a set circuit of the latching relay, and another capacitor powers a reset circuit. Only one of the capacitors is charged at any one time. While power is applied to the power terminals to illuminate the first light, one capacitor is held discharged while the other capacitor is charged in preparation for powering the latching relay. The discharge of the charged capacitor through the latching relay is controlled electronically by a triac having a control terminal which is brought to control voltage by a fourth capacitor after a third capacitor has been discharged over a predetermined short time.

21 Claims, 3 Drawing Figures

LAMP SWITCHING

BACKGROUND OF THE INVENTION

The present invention is designed to provide reduction in illumination output of a lighting system by disconnecting some of the lights from power terminals upon each alternate turning off of a main wall switch.

SUMMARY OF THE INVENTION

A power switching circuit has switching means for alternately enabling and disabling second lamp means in a group of first and second lamp means as a switch for the group of lamp means is repeatedly cycled, so that upon each alternate switching on of the group of lamp means the second lamp means will be off.

Terminals lead from a main switch which is connected to a power source.

First lamp means are connected to the terminals for illuminating the first lamps on every occasion when the main switch provides power to the terminals from the power source.

Switching means are connected to the terminals for changing from a first condition to a second condition and changing from a second condition to a first condition upon each alternate cycling of the main switch to supply power to the terminals.

Second lamp means connected to the switching means illuminate when the switching means is in a first condition in which power is supplied from the terminals through the switching means to the second lamp means.

Electronic operating means connected to the switching means changes the switching means from a first condition to a second condition and from a second condition to a first condition.

Preferred electronic operating means comprises a latching relay and means to drive the relay in either a first direction or a second direction.

Preferably, the means for driving the relay comprises means for driving the relay after power has been removed from the terminals.

In a preferred embodiment, the latching relay has set and reset coils, and the driving means comprises a first capacitor connected to the set coil and a second capacitor connected to the reset coil and means for discharging one of the first and second capacitors through the set or reset coil thereby moving the relay in one direction or the other and switching the switching means to either a first condition or a second condition.

Charging means is connected to the switching means for selectively connecting the charging means to the first or second capacitor to selectively charge the first or second capacitor.

The preferred apparatus further comprises controlled discharging means for controlling the discharge of one of the capacitors connected to the relay.

The preferred controlled discharge means comprises a thyristor having a power terminal connected to set and reset means of the relay and having a control terminal.

A control capacitor discharge circuit connected to the control capacitor and connected to the control terminal of the thyristor for turning on the thyristor and discharging a charged capacitor connected through a relay coil when the control capacitor switches on the control electronic circuit and discharges the control capacitor.

The preferred control electronic circuit comprises a diode connected to the control capacitor, a resistor, a capacitor and a second thyristor having first power terminals connected to the diode. The second thyristor has a control connected to second terminals of the resistor and the capacitor and to a first terminal of a zener diode. The second thyristor has a second power terminal connected to a second power terminal of the zener diode. As the voltage across the control electronic circuit increases to a predetermined level, the zener diode breaks down, gating the second thyristor and turning on the first thyristor.

The preferred apparatus further comprises a fourth capacitor and a third thyristor and a limiting resistor in series for controlling the discharge rate of the fourth capacitor. The third thyristor has a control terminal connected to the output terminal of the first thyristor for discharging the fourth capacitor when the first thyristor is conductive.

In the preferred apparatus, a voltage dependent resistor connected to the switching means limits spikes across the electronic control circuitry of the switching means. A current limiting resistor connected in series with the voltage dependent resistor limits current that can be applied to the voltage dependent resistor.

Preferably, a switch means is connected in series with one of the terminals and the electronic control circuit for deenergizing the electronic control circuit to change the condition of the switching means.

A diac is connected to the control terminal of the zener diode and a control capacitor is connected to the diac. As the control capacitor discharges, the diac renders the zener diode conductive and discharges the charged capacitor through the set or reset coil, respectively, of the relay.

A second relay has first and second power contacts respectively connected to set and reset terminals of the second relay. The first relay is connected to a second switching means which is connected to the control capacitor for selectively connecting the control capacitor to the set or reset terminal of the second relay. The second relay is connected to a switching means for switching a connection from the power terminal to either the first or second capacitor for selectively charging the first or second capacitor, which discharges selectively through the first relay.

The preferred second relay has a switching means and means connected to the switching means for discharging the first and second capacitors which are not being charged.

The preferred method of connecting and disconnecting second lamps from power circuits upon alternate switching off and on of power circuits comprises connecting a first lamp means to terminals of a power circuit, connecting an electronic circuit to terminals of the power circuit and connecting a second lamp means via a switching means to the power circuit upon each alternate similar changing condition of the power circuit.

In the preferred method, the connecting of the second lamp means to the power circuit comprises connecting a second lamp means to the power circuit upon each alternate turning off of the power to the terminals.

These and other objects and features of the invention are apparent in the disclosure which includes the above and ongoing description including the claims and the drawings.

DETAILED DESCRIPTION OF THE DRAWINGS

Figure 1:
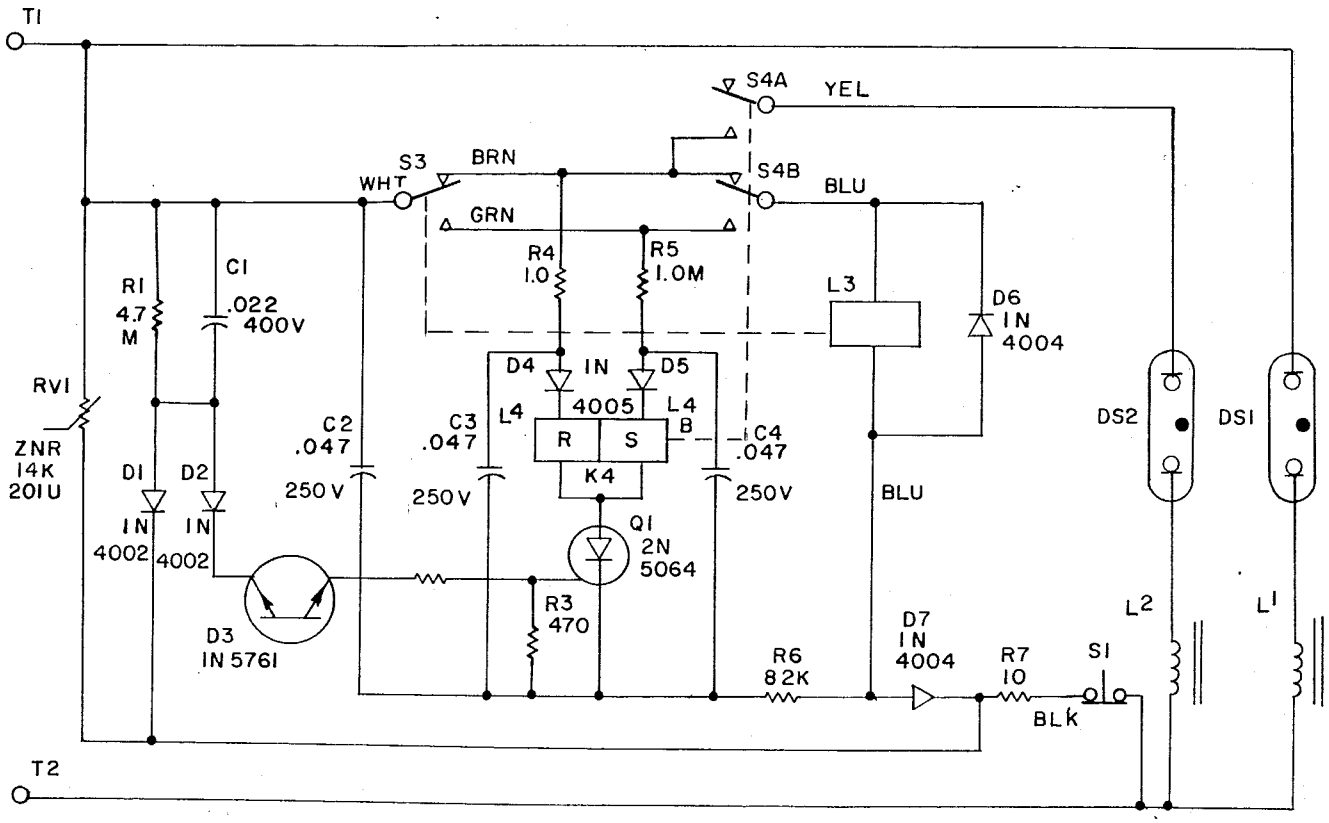
FIG. 1 describes lamp switching using a magnetic latching relay with an SCR driver.

Referring to FIG. 1, power is applied to the circuit terminals $T_1$, $T_2$ at the left. Since lamp DS1 and its ballast choke L1 are always in circuit, this lamp always lights. Initially, a circuit exists via the solenoid-operated switch S3, relay contacts S4B, Solenoid L3, diode D7, resistor R7, and switch S1, which causes solenoid L3 to pull in, operating S3 and breaking the circuit. Relay S4B remains in the state shown, but S3 now applies power via R5 to capacitor C4 and resistor R6. Capacitor C4 charges up to the peak supply voltage over a period of several time constants. The time constant of this circuit is 47 ms, so it will be fully charged in about 250 ms.

Since the thyristor Q1 has not been triggered, no current passes through it. C3 is kept discharged via R4, L3 and R6. Diodes D4 and D5 block any current flow through the relay coils between C3 and C4.

Capacitor C2 is also charged, relatively quickly, via R6, and remains charged as long as power is applied.

Capacitor C1 is also rapidly charged via diode D1, directly from the resistor R7. The resistor R1 provides a discharge path for this capacitor. When power is removed from the circuit, C1 discharges with a time constant of about 100 ms, while C2 remains fully charged. The voltage at the junction of C1 and D1 rises, and is applied via diode D2 to trigger diode (diac) D3. When the voltage across this component D3 reaches about 30 V, it breaks down, and generates a trigger pulse which is applied via R2 and R3 to the gate of the thyristor Q1, causing it to switch to a low resistance state. Since C4 is charged, Q1 discharges this capacitor via D5 and L4B, causing the relay to change state. Q1 continues to be triggered as C1 discharges, and provides a discharge path for C2 via R5.

The next application of power finds both S3 and S4A in the down position. When power is applied, L3 operates, switching S3 to the up position and completing the circuit through lamp DS2 and ballast choke L2, causing this lamp to be lit. This time, capacitor C3 charges, while C4 remains discharged. When power is again removed, and Q1 fires, C3 discharges via D4 and L4A, switching the relay contacts to the up position. This completes the cycle of operation.

Diode D6 across L3 absorbs reverse voltage transients when the current through L3 is interrupted by S3 changing state. For this kind of scheme to work, L3 must be supplied with rectified current, so it is connected to the anode of D7.

The voltage dependent resistor (VDR) RV1 absorbs surges in either polarity, limiting spikes across the control circuitry to about 250 V. The SCR is further isolated from these spikes by R4 and R5, and by the smoothing provided by R6 and C2. D2 prevents negative transients from reaching the thyristor gate, and D1 isolates this circuit from short positive transients. R7 limits the VDR current, extending its life. If R1 should fail open-circuit, the device will simply remain in its last switched state, and will not damage anything.

The relay contacts are never used to switch the lamp or solenoid currents. The relay only changes state when no voltage is present at the input terminals, but the microswitch S3 does break the solenoid current and makes the circuit via relay contacts S4A to the second lamp. For higher carrying currents, S4A could operate a solid state relay or a conventional a.c. relay with a higher current rating.

Switch S1 is provided to set the initial state of the circuit. Each time the control circuit is broken by means of S3, the relay changes state, and the solenoid follows suit as soon as the connection is restored. S1 is a momentary break type.

In the circuit shown in FIG. 1, the magnetic latching relay is alternatively set and reset shortly after the power to the circuit is removed. Thereafter, on the next application of power to the circuit, a path exists through the relay contacts and the solenoid-operated switch to operate the solenoid. Operation of the solenoid breaks this circuit, and the switcher then remains in a quiescent state until the power is removed.

The circuit shown in FIG. 1 uses a small TO-92 thyristor to pulse the relay shortly after the power is removed. Once this thyristor fires, one of two capacitors is rapidly discharged through the appropriate relay coil, causing it to change state.

Figure 2:
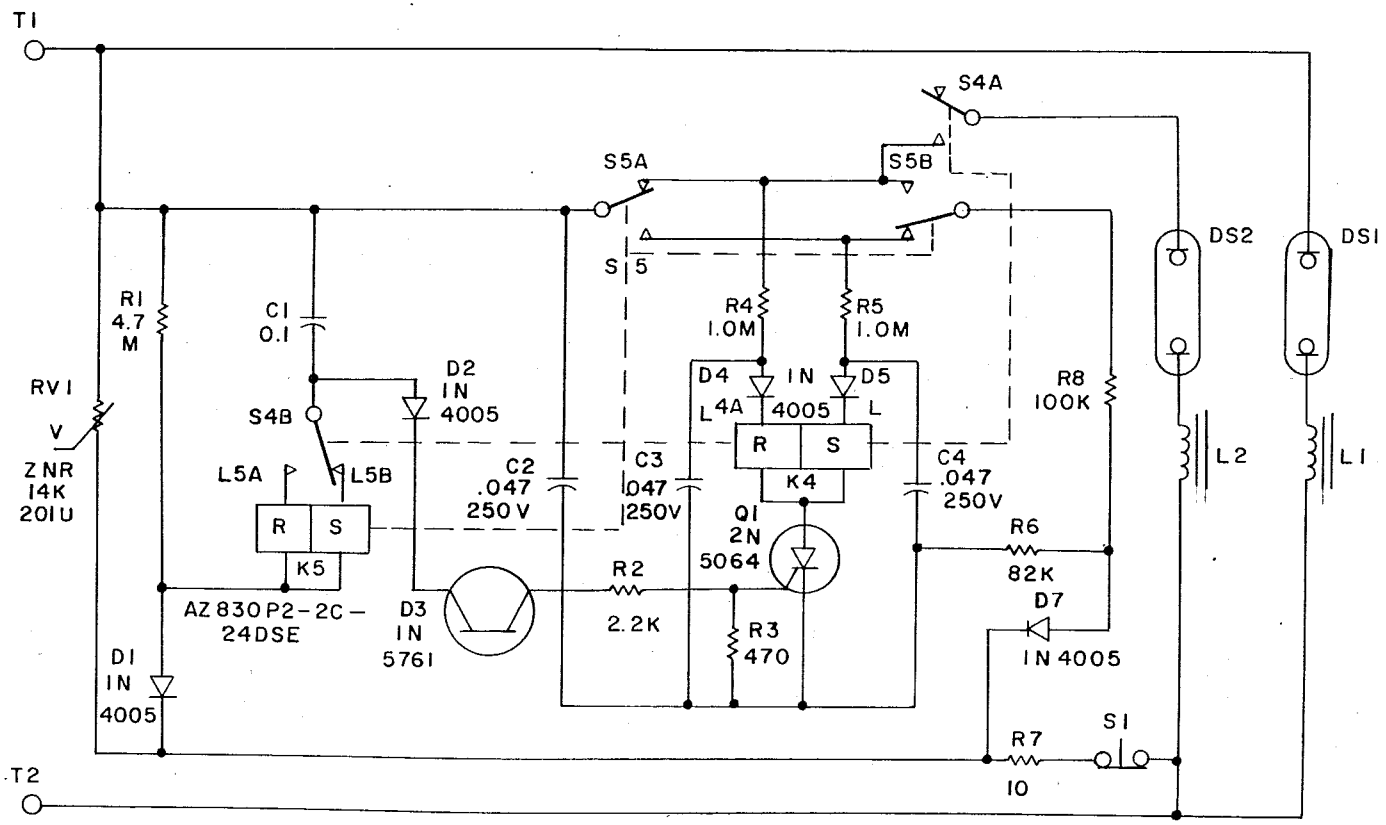
FIG. 2 describes lamp switching using two latching relays.

FIG. 2 shows a modification of this circuit which uses a second latching relay instead of a solenoid-operated switch. The circuit has only one more resistor than in FIG. 1, and the latching relay is operated in bistable mode via the switch contacts of the existing latching ralay. The operating current pulse is provided by the charging of C1 through the relay coil.

In this circuit, the solenoid operated switch of the previous circuit is replaced by one changeover contact set of 5 labelled S5A. The changeover switch S4B of K4, formerly used to drive L3, is now arranged to drive the set/reset coils of the second latching relay K5.

Referring to FIG. 2, power is applied to the circuit terminals T1 and T2 at the left. Since lamp DS1 and its ballast choke L1 are always in circuit, this lamp always lights. Initially, a circuit exists via the capacitor C1, latching relay contacts S4B, relay coil L5B, diode D1, resistor R7, and switch S1, which causes relay K5 to be set by the charging current of C1, changing over contacts S5A. S4B remains in the state shown, but S5A now applies power via resistors R5 and R6 to capacitor C4. Capacitor C4 charges up to the peak supply voltage over a period of several time constants. The time constant of this circuit is 47 ms, so it will be fully charged in about 250 ms.

Since the thyristor Q1 has not been triggered, no current passes through it. Diodes D4 and D5 block any current flow through the relay coils between C3 and C4, and S5B and R8 provide a discharge path, so that C3 remains discharged. Lamp DS2 does not light since S5A and S4A are both open.

Capacitor C2 is charged, relatively quickly, via R6, and remains charged as long as power is applied. Capacitor C1 is also rapidly charged via diode D1, directly through the relay coil L5B and the resistor R7. The resistor R1 provides a discharge path for this capacitor. The entire circuit draws 30 A when power is on.

When power is removed from the circuit, C1 discharges with a time constant of about 100 ms, while C2 remains fully charged. The voltage at the junction of C1 and D2 rises and is applied via diode D2 to trigger diode (diac) D3. When the voltage across this component reaches about 30V, it breaks down, and generates a trigger pulse which is applied via R2 and R3 to the gate of the thyristor Q1, causing it to switch to a low resistance state.

Since C4 is charged, Q1 discharges this capacitor via D5 and L4R, causing the relay to change state. Q1 continues to be triggered as C1 discharges, and provides a discharge path for C2 via R5. This quickly resets the circuit for the next operation.

The next application of power finds both S5A and S4A in the down position. When power is applied, K5 is reset, switching S5A to the up position and completing the circuit through S4A, lamp DS2 and ballast choke L2, causing this lamp to be lit. This time, capacitor C3 charges, while C4 remains discharged. When power is again removed, and Q1 fires, C3 discharges via Q1, D4 and L4A, switching the relay contacts to the up position. This completes the cycle of operation.

The VDR, RV1, absorbs surges in either polarity, limiting spikes across the control circuitry to about 250 V. The SCR is further isolated from these spikes by R4 and R5, and by the smoothing provided by R6 and C2. D2 prevents negative transients from reaching the thyristor gate, and D1 isolates this circuit from short positive transients. R7 limits the VDR current, extending its life. If R1 should fail open-circuit, the device will simply remain in its last switched state, and will not damage anything.

The relay K4 contacts are never used to switch the lamp or solenoid currents. This relay only changes state when no voltage is present at the input terminals. The contacts of latching relay K5, shown as S5A, make the circuit via relay contacts S4A to the second lamp DS2. This connection is made or broken very shortly after power is switched on, and normally before the lamp fires, so that no current is actually flowing through the contacts at the time that the circuit is made or broken. For higher carrying currents, S4A could operate a solid state relay or a conventional a.c. relay with a higher current rating.

Switch S1 is provided to set the initial state of the circuit. Each time the control circuit is broken by means of S1, the relay changes state, and the solenoid follows suit as soon as the connection is restored. S1 is a momentary break type.

Connection of the discharge path R8 to the capacitors C3 or C4 via S5B ensures the discharge of the appropriate capacitor, replacing the discharge path formerly provided by L3 in the FIG. 1 circuit. It is a necessary part of the FIG. 2 circuit, as otherwise the capacitor might charge due to leakage current via the reverse-biased diode, especially at high operating temperatures.

FIG. 2 shows the modified circuit using a second latching relay instead of the solenoid-operated switch. The circuit had only one more resistor than the original of FIG. 1 and the latching relay is operated in bistable mode via the switch contacts of the existing latching relay. The operating current pulse is provided by the charging of C1 through the relay coil.

Figure 3:
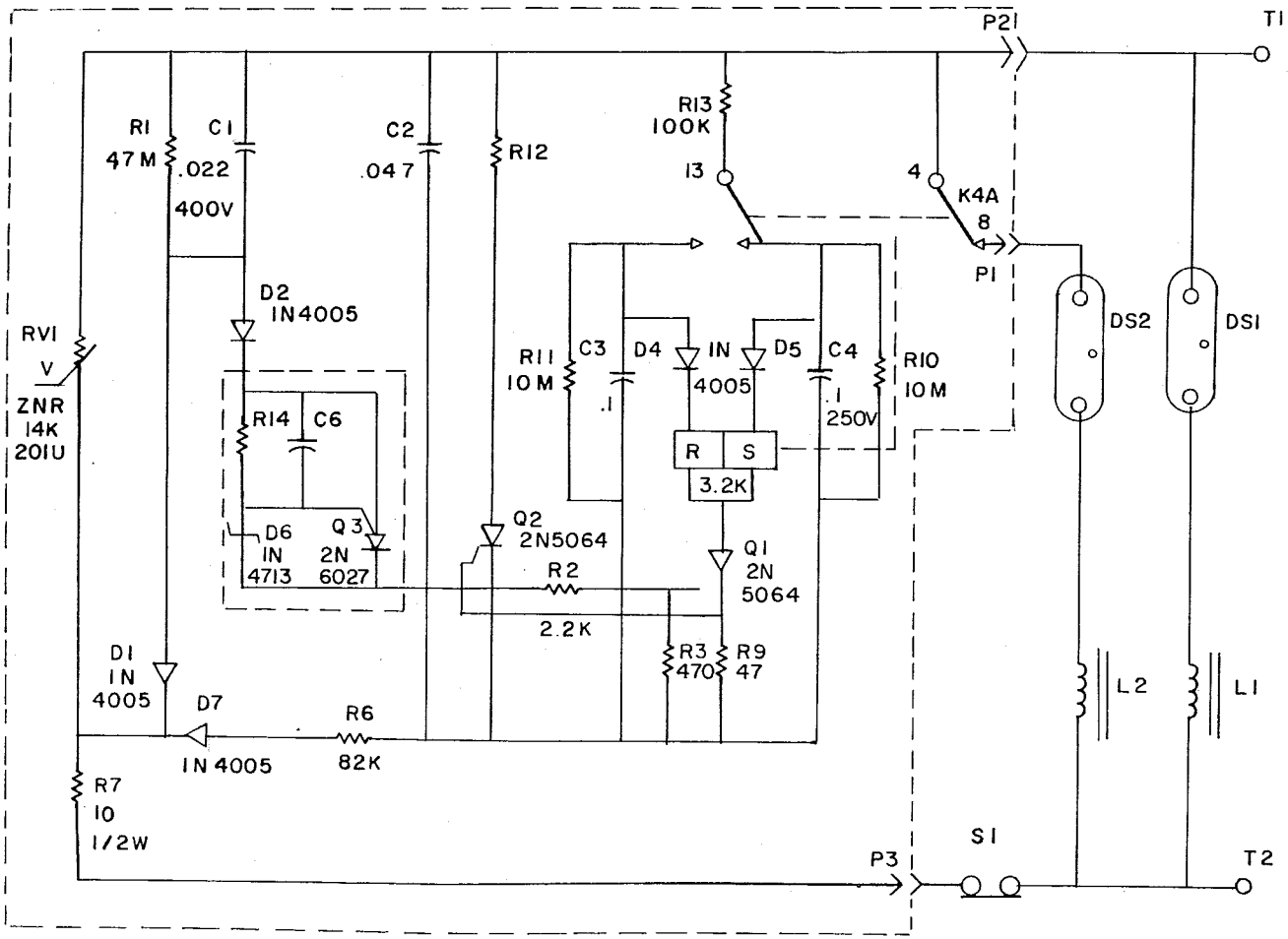
FIG. 3 shows a preferred form of the invention using a single magnetic latching relay, an SCR driver and an additional SCR discharge circuit.

A further circuit is shown in FIG. 3. This circuit eliminates the second latching relay.

A single relay may be operated shortly after the power is removed from the circuit, as is done in the circuit of FIGS. 1 and 2.

The circuit of FIG. 2 uses a contact set of K5 to steer the next charging cycle to the appropriate one of C3 or C4. The FIG. 3 circuit discharges C2 to prevent recharging of C3 or C4.

This is done by including a second 2N5064 thyristor Q2 and a small series resistor R12 to limit the discharge current. Q2 is fired by using a small resistor R9 in the cathode circuit of Q1 to apply a trigger voltage to the gate of Q2. This pulse only occurs if and when Q1 has fired and has discharged C3 or C4 via the latching relay coil. Thus, the circuit reliably detects the operation of Q1 before Q2 discharges C2.

In addition to discharging C2, the effect of Q2 is also to suppress further trigger pulses being generated by C1, R1 and the trigger circuit comprising D6, Q3, C6, and R14, which replace the IN5761 diac D3 of the circuits shown in FIGS. 1 and 2. This is because the voltage on the negative side of C1 is driven much more negative than before when C2 is discharged.

The second pole K4A of the relay K4 is used to switch the lamp load. Lamp DS2 and ballast choke L2 are connected to terminal P1.

Referring to FIG. 3, power is applied to the terminals $T_1$ and $T_2$ which are connected through a main switch, such as a wall switch to a power source at the right. The circuitry in the dashed outline represents the components in the printed circuit board assembly itself, which is connected via terminals P1, P2 and P3 to the power and to DS2. Since lamp DS1 and its ballast choke L1 are always in circuit, this lamp always lights when power is applied to terminals $T_1$ and $T_2$. Lamp DS2 has power applied via contact set K4A of relay K4, and switches on only the K4 is in the "set" condition.

When power is applied to the switching circuit, capacitor C1 is rapidly charged via rectifier diode D1 and resistor R7.

Capacitor C2 is charged more slowly via rectifier diode D7 and resistor R6 and R7. Thus the potential difference between the negative terminal of C1 and the negative terminal of C2 is negative, and reverse bias is applied to D2, hence no triggering of Q1 can occur. The relay remains in the initial state. If, as shown, relay K4 is in the reset state, capacitor C4 is charged via resistor R13 and the second contact set of K4B. Simultaneously, capacitor C3 is maintained in a discharged condition by resistor R11 to prevent a build-up of voltage otherwise possible through leakage current of diode D4, which is reverse biased.

With typical values of R11 and R10 of 10MΩ, and R1 being 4.7MΩ, the total current drawn by the circuit is approximately 50 μA and it remains in this quiescent condition until the power is switched off for at least 100 ms or so.

When power is removed from the circuit, C1 discharges with a time constant of about 100 ms, while C2 discharges much more slowly through R13 and R10. The voltage at the junction of C1 and D2 rises rapidly, and is applied via diode D2 to the trigger circuit comprising resistor R14, capacitor C6, zener diode D6 and programmable unijunction transistor Q3.

These components replace and are interchangeable with the disc D3 of the previous circuits shown in FIGS. 1 and 2. When the voltage across this circuit reaches about 30 V, the zener diode D6 conducts, firing Q3 which rapidly switches to the low resistance state, generating a trigger pulse. This is applied via R2 and R3 to the gate of the thyristor Q1, causing it to switch to a low resistance state. Since C4 is charged, Q1 discharges this capacitor via D5 and the set coil of K4, causing the relay to change state.

When Q1 fires, the voltage developed across resistor R9 is applied to the gate of thyristor Q2, triggering it to a low resistance on state. This rapidly discharges C2 via R12, which limits the peak current to a safe value for the thyristor. This quickly resets the circuit for the next operation.

The next application of power finds K4 in the set condition. As before no switching action occurs at this time, but since K4B is now in the set position, C3 is now charged via R3 and K4B, while C4 remains discharged via R10. When power is again removed, and Q1 fires, C3 discharges via Q1, D4 and the reset coil of K4, switching the relay to the reset position. This completes the cycle of operation.

The VDR, RV1, absorbs surges in either polarity, limiting spikes across the control circuitry to about 250 V. The series resistor R7 limits the current that can be applied to RV1. The thyristor Q1 is further isolated from these spikes by R13 and C4 or C3, and by the smoothing provided by R6 and C2. D2 prevents negative transients from reaching the thyristor gate, and D1 isolates this circuit from short positive transients. R7 limits the VDR current, extending its life. If R7 should fail open-circuit, the device will simply remain in its last switched state, and will not damage anything.

The contacts of relay K4 are never used to switch the lamp current, as this relay only changes state when there is no voltage present at the input terminals. The contact set K4A of latching relay K4 makes the circuit to the second lamp DS2. This connection is made or broken alternately as the switcher operates. The advantage of this configuration is that the relay can operate loads up to its carrying current, instead of being limited to the maximum switched current for inductive loads, which is generally much smaller.

Switch S1 is provided to set the initial state of the circuit. Each time the control circuit is broken by means of S1, the relay changes state. S1 is a momentary break type, and needs only a 1 A current rating at 120 V.

The invention has been described with reference to specific embodiments. Other embodiments may be constructed within the scope of the invention, which is defined in the following claims.

We claim:

1. A power switching circuit means for alternately switching off and on second lamp means in a group of first and second lamp means as the group of lamp means is repeatedly switched on so that upon each alternate switching on of the group of lamp means the second lamp means will be off, comprising:

terminals for connecting to a main switch from a power source, first lamp means connected to the terminals for illuminating on every occasion in which the main switch provides power to the terminals from the power source, switching means connected to the terminals for changing from a first condition to a second condition and changing from a second condition to a first condition upon each alternate supplying of power to the terminals, second lamp means connected to the switching means for illuminating when the switching means is in a first condition in which power is supplied from the terminals through the switching means to the second lamp means, and electronic operating means connected to the switching means for changing the switching means from a first condition to a second condition and from a second condition to a first condition.

2. The apparatus of claim 1 wherein the electronic operating means comprises a latching relay and means to drive the relay in either a first direction or a second direction.

3. A power switching circuit means for alternately switching off end on second lamp means in a group of first and second lamp means as the group of lamp means is repeatedly switched on so that upon each alternate switching on of the group of lamp means the second lamp means will be off, comprising:

terminals for connecting to a main switch from a power source, first lamp means connected to the terminals for illuminating on every occasion in which the main switch provides power to the terminals from the power source.

switching means connected to the terminals for changing from a first condition to a second condition and changing from a second condition to a first condition upon each alternate supplying of power to the terminals, second lamp means connected to the switching means for illuminating when the switching means is in a first condition in which power is supplied from the terminals through the switching means to the second lamp means, and electronic operating means connected to the switching means for changing the switching means from a first condition to a second condition and from a second condition to a first condition, wherein the electronic operating means comprises a latching relay and means to drive the relay in either a first direction or a second direction, wherein the means for driving the relay comprises means for driving the relay after power has been removed from the terminals.

4. The apparatus of claim 3 wherein the latching relay has set and reset coils and wherein the driving means comprises a first capacitor connected to the set coil and a second capacitor connected to the reset coil and means for discharging one of the first and second capacitors through the set or reset coil thereby mvoing the relay in one direction or the other and switching the switching means to either a first condition or a second condition.

5. The apparatus of claim 4 further comprising charging means connected to the switching means for selectively connecting the charging means to one of the first and second capacitors to selectively charge one of the first and second capacitors.

6. The apparatus of claim 4 further comprising controlled discharging means for controlling the discharge of one of the capacitors connected to the relay.

7. The apparatus of claim 6 wherein the controlled discharge means comprises a thyristor having a power terminal connected to set and reset means of the relay and having a control terminal.

8. The apparatus of claim 7 further comprising a control circuit connected to a control capacitor means and connected to the control terminal of the thyristor for turning on the thyristor and discharging one of the first and second charged capacitors connected through the set or reset relay coil when the control circuit switches on the thyristor and discharges the control capacitor.

9. The apparatus of claim 8 wherein the control circuit comprises a diode connected to the control capacitor means, a resistor, a capacitor and a second thyristor having first power terminals connected to the diode, the second thyristor having a control connected to second terminals of the resistor and the capacitor and to a first terminal of a zener diode and the second thyristor having a second power terminal connected to a second power terminal of the zener diode whereby, as the voltage across the control circuit changes to a predetermined level, the zener diode breaks down, gating the second thyristor and turning on the first thyristor.

10. The apparatus of claim 9 wherein the control capacitor means further comprises third and fourth capacitors, means for discharging the third capacitor and means for applying a charge on the fourth capacitor to a junction with the third capacitor and a second thyristor and limiting resistor in series for controlling the discharge of the fourth capacitor, the second thyristor having a control terminal connected to the output terminal of the first thyristor for discharging the fourth capacitor when the first thyristor has conducted.

11. The apparatus of claim 7 further comprising a diac connected to the control terminal of the thyristor and a control capacitor means connected to the diac whereby, as the control capacitor means changes voltages, the diac renders the thyristor conductive and discharges the charged capacitor through the set or reset coil, respectively, of the relay.

12. The apparatus of claim 11 further comprising a second relay having first and second power contacts respectively connectable to the first and second capacitors, which are connected to the set and reset coils of the second relay, the first relay being connected to a second switching means which is connected to a control circuit of the control capacitor means for selectively connecting the control capacitor means to the set or reset terminal of the second relay, the second relay being connected to a switching means for switching a connection from a power terminal to either the first or second capacitor for selectively charging the first or second capacitor, which discharges selectively through the first relay.

13. The apparatus of claim 12 wherein the second relay has a switching means and means connected to the switching means for discharging the first and second capacitors which are not being charged.

14. The apparatus of claim 12 wherein the control capacitor means further comprises a third capacitor connected to a fourth capacitor at one junction and to a discharge circuit of the third capacitor at a second junction so that the fourth capacitor increases voltage on the second junction as the third capacitor is discharged.

15. The apparatus of claim 4 further comprising a voltage dependent resistor connected to the switching means for limiting spikes across the electronic control circuitry of the switching means and a current limiting resistor connected in series with the variable resistor for limiting current that can be applied to the variable resistor.

16. The apparatus of claim 4 further comprising a switch means connected in series with one of the terminals and the electronic control circuit for de-energizing the electronic control circuit to change the condition of the switching means.

17. The method of connecting and disconnecting second lamps from power circuits upon alternate switching off and on of power circuits comprising connecting a first lamp means to terminals of a power circuit, connecting an electronic circuit to terminals of the power circuit and connecting a second lamp means via a switching means to the power circuit upon each alternate similar changing condition of the power circuit by operating the switching means with the electronic means to change the switching means from a first condition to a second condition by alternate powering of the power circuits.

18. The method of claim 17 wherein the connecting of the second lamp means to the power circuit comprises connecting a second lamp means to the power circuit upon each alternate turning off of the power to the terminals.

19. The method of connecting and disconnecting second lamps from power circuits upon alternate switching off and on of power circuits comprising connecting a first lamp means to terminals of a power circuit, connecting an electronic circuit to terminals of the power circuit and connecting a second lamp means via a switching means to the power circuit upon each alternate similar changing condition of the power circuit by operating the switching means with the electronic means to change the switching means from a first condition to a second condition by alternate powering of the power circuits, wherein the connecting of the second lamp means to the power circuit comprises connecting a second lamp means to the power circuit upon each alternate turning off of the power to the terminals, further comprising charging a first capacitor when power is on, discharging the first capacitor through a first coil of latching relay when the power is off, changing the switching means to a first condition, connecting the power circuit to the second lamp means, when the first capacitor discharges through the first coil of the latching relay, charging a second capacitor when the power circuit is next turned on, discharging the second capacitor through a second coil of the relay when the power is next turned off, switching the switching means to a second condition disconnecting the terminals from the second lamp when the second capacitor is discharged through the second coil of the relay.

20. The method of claim 19 further comprising discharging the second capacitor while the first capacitor is charging and discharging the first capacitor while the second capacitor is charging.

21. The method of claim 19 further comprising controlling discharging of one of the first and second capacitors through the relay by controlling a discharge means with voltage at a junction of third and fourth capacitors.

* * * * *